US007598456B2

(12) United States Patent
Mertel

(10) Patent No.: US 7,598,456 B2
(45) Date of Patent: Oct. 6, 2009

(54) CONNECTION OF ELECTRICAL CABLES

(75) Inventor: Adelheid Mertel, Willich (DE)

(73) Assignee: Auto Kabel Managementgesellschaft mbH, Hausen .i.W. (DE)

( * ) Notice: Subject to any disclaimer, the term of this patent is extended or adjusted under 35 U.S.C. 154(b) by 288 days.

(21) Appl. No.: 11/813,711

(22) PCT Filed: Feb. 3, 2006

(86) PCT No.: PCT/EP2006/050648

§ 371 (c)(1),
(2), (4) Date: Jul. 11, 2007

(87) PCT Pub. No.: WO2006/082231

PCT Pub. Date: Aug. 10, 2006

(65) Prior Publication Data

US 2008/0190641 A1 Aug. 14, 2008

(30) Foreign Application Priority Data

| | | |
|---|---|---|
| Feb. 3, 2005 | (EP) | 05002211 |
| Jun. 13, 2005 | (EP) | 05012641 |
| Sep. 8, 2005 | (EP) | 05019546 |

(51) Int. Cl.
*H01R 4/00* (2006.01)

(52) U.S. Cl. ..... 174/84 R

(58) Field of Classification Search ..... 174/74 R, 174/77 R, 79, 84 R, 85, 88 R, 88 C, 91, 92; 29/825

See application file for complete search history.

(56) References Cited

U.S. PATENT DOCUMENTS

| | | | | |
|---|---|---|---|---|
| 4,484,022 | A * | 11/1984 | Eilentropp | 174/84 R |
| 5,977,504 | A * | 11/1999 | Offer et al. | 219/75 |
| 6,919,512 | B2 * | 7/2005 | Guven et al. | 174/84 R |
| 2002/0043806 | A1 * | 4/2002 | Neumaier et al. | 285/369 |

FOREIGN PATENT DOCUMENTS

| | | |
|---|---|---|
| GB | 1175547 | 12/1969 |

* cited by examiner

*Primary Examiner*—William H Mayo, III
(74) *Attorney, Agent, or Firm*—Sunstein Kann Murphy & Timbers LLP

(57) ABSTRACT

A method for the production of an electrical connection between at least two cables, particularly battery leads for motor vehicles, wherein at least one first cable is formed by one conductor and one insulating sheath and at least one second cable is at least formed by one conductor. In order to ensure a positionally stable connection of the conductors, a method and device are characterized in that the cables are connected with the aid of multi-orbital welding such that an integral joint is established between the cable conductors.

15 Claims, 3 Drawing Sheets

CONNECTION OF ELECTRICAL CABLES

TECHNICAL FIELD

The invention relates to a method of making an electrical connection between at least two cables, and particularly battery cables for motor vehicles, at least one first cable being formed from a conductor and an insulating sheath and at least one second cable being formed from at least one conductor. The invention also relates to an arrangement for making a connection between at least two cables, and particularly battery cables for motor vehicles, comprising at least one first cable having a conductor and an insulating sheath and at least one second cable having at least one conductor.

BACKGROUND

Nowadays, the fixing and connecting of cables to one another by material connection can be accomplished by, for example, welding or soldering. It has been found that friction welding processes, and in particular rotational friction welding processes, are suitable for connecting two cables. However, in rotational friction welding it is necessary for the individual wires of a conductor to be pressed together by means of a supporting sleeve so that they do not straddle in the rotational friction welding. Also, in rotational friction welding only one workpiece at a time can be connected to another. Each connection needs a stage of operation of its own. Finally, at least one of the members to be joined has to be freely rotatable on its axis in rotational friction welding.

It is also known for electrical interfacing terminal points to be arranged on flat conductors. In this case too it has been proposed that an interfacing terminal point be arranged on the flat cable by friction welding. However, it has been found that in rotational friction welding the fixed position of the pin cannot be set with sufficient accuracy. Also, in the case of conventional interfacing terminal points, it is known for a threaded pin to be inserted in a hole in the flat conductor and for a sleeve to be screwed onto the thread. The sleeve then presses the pin against the flat conductor. However, a structure of this kind makes it necessary for certain minimum dimensions to be maintained, in order for example to ensure the shear strength of the thread on the pin. Hence it is not possible for interfacing terminal points of less than a minimum overall height to be provided by conventional methods. Also, a connection of this kind is only possible to copper conductors. With aluminum conductors, the making of electrical contact may be disturbed with by a layer of aluminum oxide on the conductor and/or the sleeve.

The object underlying the invention has therefore been to provide a method and a connecting arrangement for conductors which are distinguished by easy manipulability, low production costs and a very fixed position for the connection.

SUMMARY OF THE INVENTION

To achieve the object derived from the prior art which is identified above, the application proposes a method as defined in the preamble to claim 1 which is characterised in that the cables are connected by means of multi-orbital welding in such a way that a connection by material connection is made between the conductors of the cables.

Because of the use of multi-orbital welding, in which the workpieces to be welded together can be moved in circular, orbital movements of small radii relative to one another, high fixity of positioning can be achieved for the welded joint. What is more, with multi-orbital welding it is no longer necessary for one of the workpieces intended for welding to be clamped into a tool which rotates on the axis of the workpiece. By virtue of the multi-orbital welding, it may merely be necessary for the workpieces to be caused to perform small elliptical or circular movements relative to one another. The contact pressure between the workpieces is considerably lower than in rotational friction welding. Also, joints of low overall height can be made because the tools do not have to hold the workpiece directly above the weld site but may also do so to one side thereof.

In an advantageous embodiment, it is proposed that free end-faces of two cables be connected together. By the use of multi-orbital welding, a butt joint of this kind can be made inexpensively and with joining technology which do not have to meet exacting demands.

It is particularly advantageous if, during the multi-orbital welding, the conductors are connected by material connection at the free end-faces and the sheaths of the cables are connected by material connection, in such a way that a means of sealing off the weld is produced by the connection of the cable sheaths. The seal may serve as protection for the weld against ambient factors. Multi-orbital welding is distinguished by the fact that different materials can be connected together in a single stage of operation. In this way, it is for example possible for two cables which are each formed from at least one conductor and one cable sheath to be connected together by a butt joint. When multi-orbital welding is employed, what happens when the end-faces are welded together is both that the two conductors are connected together by material connection and also that is there a connection by material connection made between the insulating materials of the cables sheaths. The connection between the cable sheaths at once seals off the weld. It is no longer necessary for the weld to be sealed off with a shrink tubing.

The method according to the application is particularly suitable for connections between aluminum conductors, conductors of non-ferrous metals, or conductors of other metallic materials or alloys thereof. An intermetallic connection may be made in this case both between materials of the same kind and also between different materials. The method described above is particularly suitable for aluminum welds because these are protected against corrosion immediately after the welding.

It is also advantageous if the first cable is in the form of a flat cable and the second cable is in the form of a connecting pin and if, during the multi-orbital welding, the connecting pin is connected to a flat face of the conductor of the flat cable substantially by a T joint. A connection of this kind provides an interfacing terminal point. The pin may be applied directly to the flat conductor. It is not necessary for a hole to be made in the flat connector or for the interfacing terminal point to be constructed as described above. Because the connecting pin is welded to the flat cable by multi-orbital welding, great fixity of position is obtained for the pin. Because of this, connecting surfaces arranged on the pin for connections to other cables can be arranged in exactly defined positions relative to the flat cable.

In the welding, the pin is fed into the sheath of the flat cable. In an advantageous embodiment, the pin is connected to the sheath of the flat conductor by form closure along its circumferential surface by the multi-orbital welding, in such a way that insulation is formed for the weld. The circumferential surface of the pin, which is in direct contact with the insulating sheath of the flat cable, is connected to the cable sheath by form closure during the multi-orbital welding. During the multi-orbital welding, the insulating material of the cable sheath is melted and joins itself to the circumferential surface of the pin. This ensures that there is at least a form-closed connection between the pin and the cable sheath, which results in the weld being insulated.

A particular preference is for the pin to comprise a ring shoulder. This annular shoulder may be arranged a short distance above the end-face. Starting from the end-face, the pin then changes from its original shape to the shape of the ring shoulder.

In an advantageous embodiment, protection/sealing-off is provided for the weld by virtue of the fact that the ring shoulder on the pin is formed from metal, and that during the multi-orbital welding at least part of that side of the ring shoulder which is adjacent to the flat conductor is connected to the sheath of the flat conductor by form-closed. The ring shoulder is so arranged on the pin that it is at a distance from the end-face of the pin approximately corresponding to the thickness of the cable sheath. If the pin is then welded to the flat conductor by multi-orbital welding, the cable sheath, which is situated underneath the face of the ring shoulder, is melted, which gives a form closure between the underside of the ring shoulder and the sheath of the cable.

The weld is sealed off with particular tightness if the ring shoulder on the pin is formed from insulating material and if, during the multi-orbital welding, at least part of that side of the ring shoulder which is adjacent to the flat conductor is connected to the sheath of the flat conductor by material connection. When this is the case, a connection by material connection is made not only between the end-face of the pin and the flat conductor but also between the ring shoulder and the sheath of the flat conductor. This connection by material connection between the cable sheath and the ring shoulder ensures that the weld is sealed off reliably in only one stage of operation.

An interfacing terminal point can be produced particularly easily if, in an advantageous embodiment, the pin is driven through the sheath of the first conductor during the multi-orbital welding. When this is the case, the material of the sheath is forced aside by the pin during the welding and, in the melted state, clings directly to the pin, thus once again ensuring that the weld is insulated.

It is also preferable if, before the multi-orbital welding, the sheath of the first conductor is provided with an opening approximately corresponding to the cross-section of the pin. An opening of this kind can be cut out of the sheath. In an advantageous embodiment this is done by means of a laser. When this is the case, the pin can be placed directly down on the flat conductor and welded to it.

To ensure that a good weld is made, it is proposed in an advantageous embodiment that the front face of the conductor have a recess in such a way that weld metal is received therein. The recess may take the form of a blind hole or groove (s) . During the multi-orbital welding the workpieces to be welded together are melted and the weld metal escapes at the joints. In an advantageous embodiment the weld metal is guided into the interior of the recess, which results in a good connection between the cables.

A further aspect of the application is an arrangement for making a connection between at least two cables, and in particular battery cables of motor vehicles, comprising at least one first cable having a conductor and an insulating sheath, and at least one second cable having at least one conductor, which arrangement for making a connection is characterised in that there is a connection by material connection between the conductors of the cables which is produced by means of multi-orbital welding.

The invention will be explained in detail below by reference to drawings showing embodiments. In the drawings:

DETAILED DESCRIPTION OF THE DRAWINGS

For multi-orbital welding as it is to be applied in accordance with the application, the workpieces to be joined are clamped into tools on the two sides at points adjacent to the faying faces. The faying faces are pressed against one another.

For welding by multi-orbital welding, the faying faces are caused to perform orbital motions, the tools moving orbitally in phase opposition to one another in xz, yx and/or yz directions, depending on how the clamping-in is arranged in the system. The tools may move orbitally in this case in a fixed phase position, 180° out of phase with one another. It is preferable for the workpieces each to move orbitally in only one plane, and for an applying pressure to be applied from a direction perpendicular to this plane.

In multi-orbital welding, the parts to be joined are connected together by material connection after less than a minute, and preferably after only a few seconds, such for example as 5-7 seconds. The weld beads are small because only relatively little process heat is generated. Further processing can begin immediately after the welding operation because a holding/cooling time is no longer necessary.

The start-up of the tools can be synchronised, starting from the opposed-phase phase position. The phase angle between the orbital movements of the tools can be precisely controlled during the welding operation. It is possible for the tools to move relative to one another in elliptical orbital movements. A circular orbital movement is also possible. An axially oscillating crank movement as of a is produced between the workpieces.

In the elliptical orbital movements in opposite directions, one of the axes of the ellipse, a or b, may also approach 0. The frequency of the circular orbital movements may be between 20 Hz and a few 100 Hz. The maximum amplitude of the orbital movement may be less than 3 mm.

Figure 1:
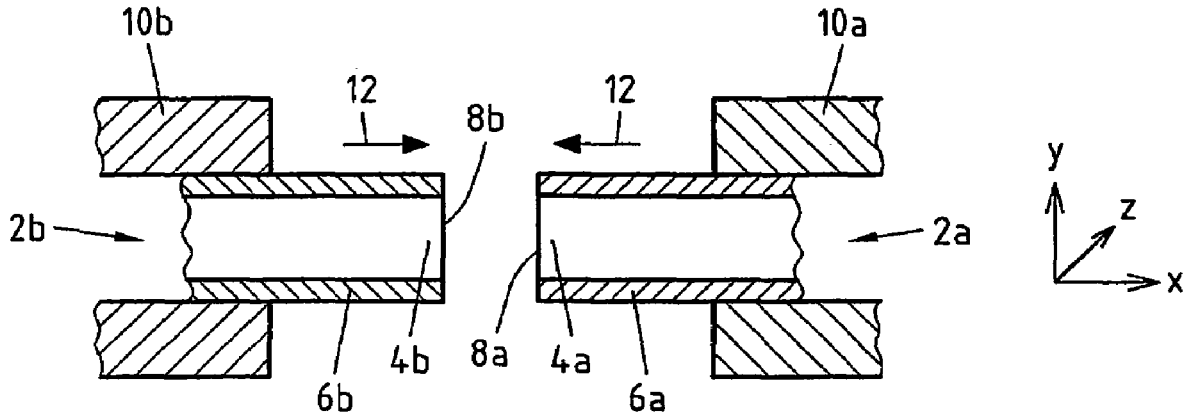
FIG. 1 shows an arrangement for the multi-orbital welding of cable ends.

An arrangement as shown in FIG. 1 is advantageous for joining cables. Shown in FIG. 1 are the ends 2*a*, 2*b* of cables 2, the cable ends 2*a*, 2*b* each being formed by a metal conductor 4 and a cable sheath 6. The cable ends 2*a*, 2*b* are each clamped into tools 10 in the immediate vicinity of the end-faces 8. It is possible for one tool to be fixed and for the other tool to perform the welding movements. For the cable ends 2*a*, 2*b* to be welded together, they are moved towards one another by the tool in direction 12 along the x axis. For the welding together, contact pressure is generated between the cable ends 2*a*, 2*b* by the tools 10 on the x axis. The tools 10 also perform circular movements in phase opposition to one another. Circular movements are performed on the yz axes in this case. By the circular movements in phase opposition, which may also take place around different centres, the conductors 4 of the cables 2 are welded together by material connection within a short time. What is more, the sheaths 6 of the cables, which are formed from insulating material, are welded together by material connection at the same time.

Figure 2:
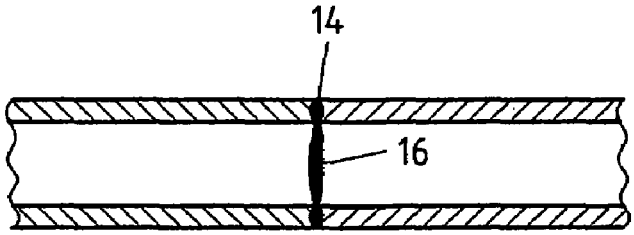
FIG. 2 shows two cables which have been butt-jointed together.

The result of the multi-orbital welding of the cables 2 is shown in FIG. 2. The end-faces 8 both of the conductors 4 and of the cable sheaths 6 are welded together. Welds 14 have formed between the ends of the cable sheaths 6. A weld 16 has also formed between the conductors 4. The weld 14 seals off the weld 16, which means that neither oxygen nor moisture can attack the weld 16 from outside. Materials of the most widely varying kinds can be connected together by multi-orbital welding in a single stage of operation. It can be seen that, as well as the conductors 4, which are formed from metal, being welded together, the cables sheaths 6, which are formed from non-metals, are, in addition, welded together. The conductors 4 may be formed from ferrous metals and non-ferrous metals, such as aluminum, copper or other non-ferrous metals, or alloys thereof. By the welding together according to the application, metals of the most widely varying kinds can be welded together. In addition, non-metals can also be welded together in the same operation.

Figure 3:
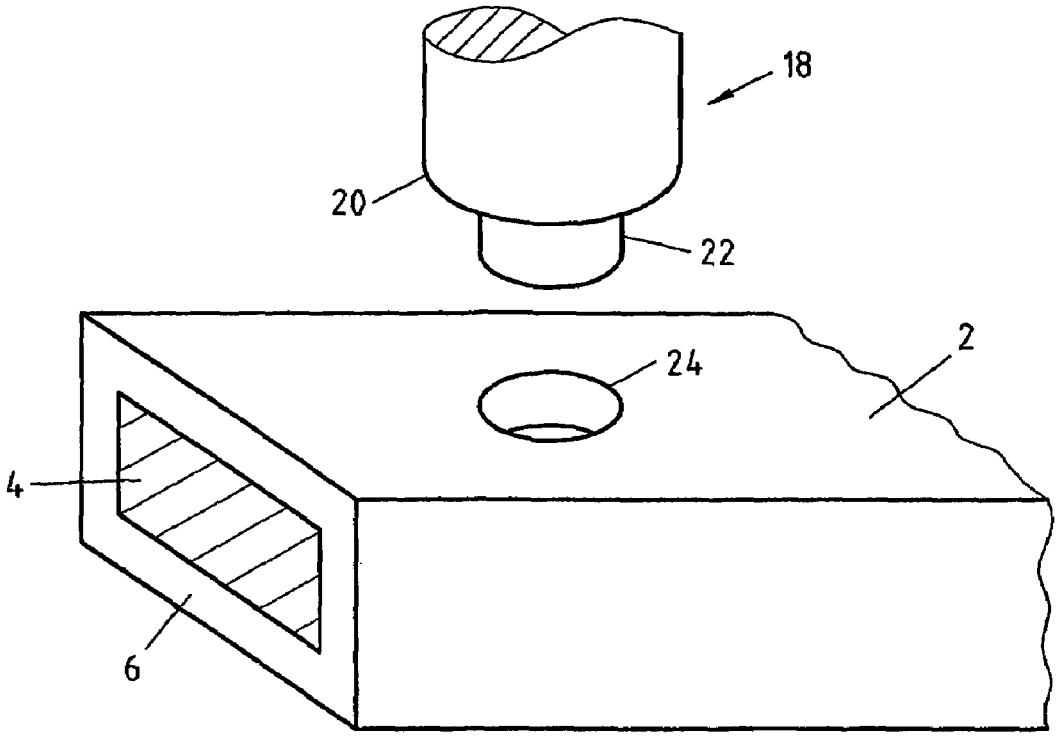
FIG. 3 is a view of an arrangement for joining a pin to a flat cable.

FIG. 3 is a view of an arrangement for welding a pin 18 to a flat cable 2. Both the flat cable 2 and the pin 18 are clamped into multi-orbital welding tools (not shown) . The pin 18 is formed to have a ring shoulder 20 and a projection 22. A recess 24 is provided in the flat cable 2. The size of the recess 24 corresponds to that of the projection 22 on the pin 18. To weld the pin 18 to the flat cable 2, the pin 18 is introduced into the recess 24 and the workpieces are welded together.

Figure 4:
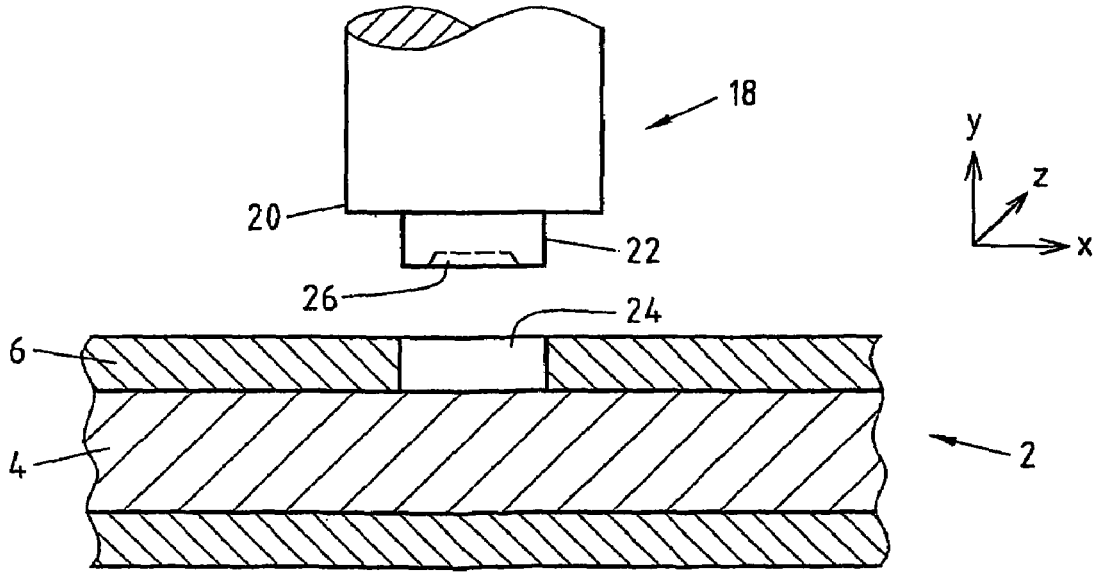
FIG. 4 is a view in section of an arrangement as shown in FIG. 3.

FIG. 4 is a view in section of the arrangement shown in FIG. 3. What can also be seen is the recess 26, which is arranged in the projection 22 at the end-face of the pin 18 in the form of a blind hole. The recess 24 can be cut out of the cable sheath 6 by means of a laser.

It is preferable for the recess 24 to be, at a minimum, smaller than the diameter of the projection 22, and preferably to be 0.01-10% thereof, so that the circumferential surface of the projection 22 is in contact with the cable sheath 6 when the pin 18 is introduced into the recess 24.

For the welding, the pin 18 is introduced into the recess 24. With the workpieces clamped-in as shown, the multi-orbital welding tools (not shown) start an orbital movement in the xz plane and the pressurisation takes place in the y direction. The orbital movements of the workpieces 4 and 18 relative to one another may be elliptical or circular and may be between 90° and 180° out of phase. It is also possible for only the pin 18 to move orbitally in the xz plane and for the cable 2 to be clamped in a fixed position. By the multi-orbital welding of the pin 18 to the cable 2, the end-face of the projection 22 is connected to the conductor 4 by material connection. A connection by material connection or form closure can also be made between the circumferential surface 22 or the ring shoulder 20 and the cable sheath 6.

Figure 5:
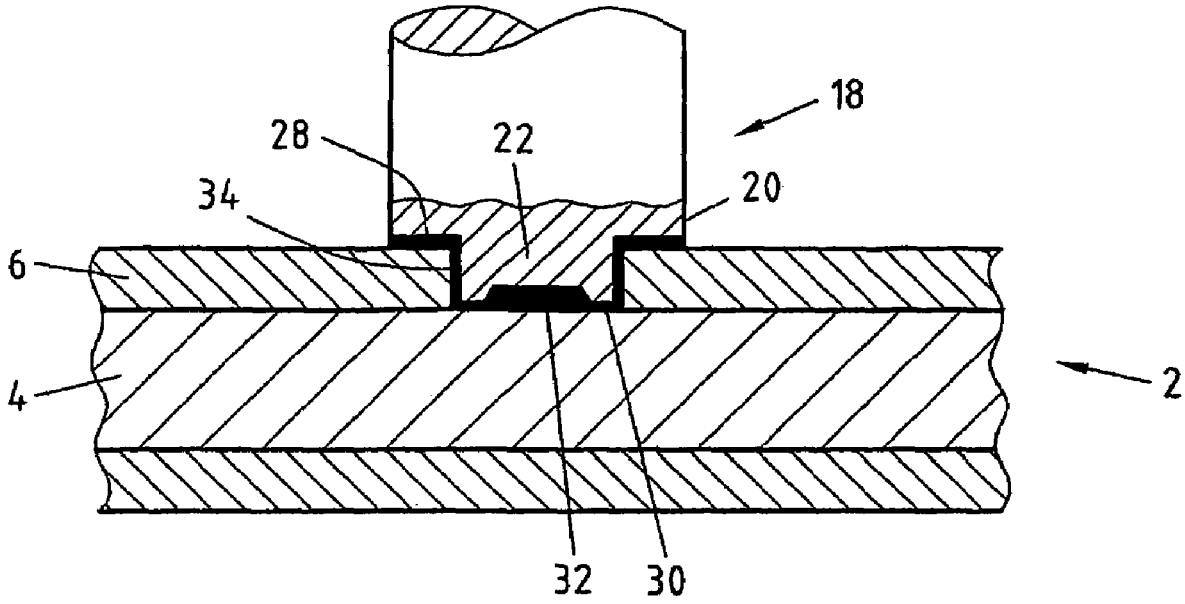
FIG. 5 is a view in section of a pin welded to a flat cable.

FIG. 5 shows a result of the pin 18 being welded to the cable 2. The welding produces a welded connection 30 by material connection between the pin 18 and the conductor 4 at least across the end-face of the projection 22. Weld metal 32 is able to flow into the recess 26.

A connection 34 by form closure can be made between the circumferential surface of the projection 22 and the cable sheath 6 by the multi-orbital welding. During the welding, the insulating material of the cable sheath 6 is melted and then clings firmly to the circumferential surface of the projection 22. This ensures that the weld 30 is sealed off.

If the ring shoulder 22 on the pin 18 is of metal, then a weld 28 on that side of the ring shoulder 20 which is adjacent to the cable sheath 6 may be a connection by form closure. During the welding, the fact of the ring shoulder 20 resting on the cable sheath 6 causes the latter to melt in the area concerned and a welded joint 28 by form closure is produced.

In the event of the ring shoulder 20 being formed from an insulating material, and preferably from the same material as the cable sheath 6, a welded connection 28 by material connection is produced between the annular shoulder 20 and the cable sheath 6 during the welding of the pin 18 to the conductor 4. This connection by material connection once again seals the weld 30 off securely and reliably.

The multi-orbital welding to one another of the cables ensures, in one stage of operation, a connection between conductors whose position is stable and which is secure, reliable and beneficial.

The invention claimed is:

1. A cable apparatus comprising at least one first cable having a conductor and an insulating sheath; and at least one second cable having at least one conductor, wherein there is a connection by material connection between the conductors of the cables produced by multi-orbital welding.

2. The cable apparatus of claim 1 wherein the first and second cable are adapted for use as motor vehicle battery cables.

3. Method of making an electrical connection between at least two cables, and particularly battery cables for motor vehicles comprising:

providing at least one first cable formed from a conductor and an insulating sheaths;

providing at least one second cable formed from at least one conductor; and performing multi-orbital welding on the cables in such a way that a connection by material connection is made between the conductors of the cables.

4. Method according to claim 3, wherein free end-faces of two cables are connected together.

5. Method according to claim 4, wherein during the multi-orbital welding, the conductors are connected by material connection at the free endfaces and the sheaths of the cables are connected by material connection, in such a way that insulation for the weld is produced by the connection of the cable sheaths.

6. Method according to claim 3 wherein the first cable is in the form of a flat cable, in that the second cable is in the form of a connecting pin and in that, during the multi-orbital welding, the connecting pin is connected to a flat face of the flat cable substantially by a T joint.

7. Method according to claim 6 wherein the pin is connected to the sheath of the flat conductor by form closure along its circumferential surface by the multi-orbital welding, in such a way that insulation of the weld is produced.

8. Method according to claim 6 wherein the pin comprises a ring shoulder.

9. Method according to claim 8 wherein the ring shoulder on the pin is formed from metal, and wherein, during the multi-orbital welding, at least part of that side of the ring shoulder which is adjacent the flat conductor is connected to the sheath of the flat conductor by form closure, in such a way that insulation is produced for the weld.

10. Method according to claim 8 wherein the ring shoulder on the connecting pin is formed from insulating material and wherein, during the multi-orbital welding, at least part of that side of the ring shoulder which is adjacent the flat conductor is connected to the sheath of the flat conductor by material connection, in such a way that insulation is produced for the weld.

11. Method according to claim 6 wherein the pin is driven through the sheath of the first conductor during the multi-orbital welding.

12. Method according to claim 6 wherein before the multi-orbital welding, the sheath of the first conductor is provided with an opening approximately corresponding to the cross-section of the pin.

13. Method according to claim 12 wherein the opening is cut out of the sheath by means of a laser.

14. Method according to claim 3 wherein the front face of a conductor comprises at least one recess in such a way that weld metal is received therein.

15. Method according to claim 14 wherein the recess takes the form of a blind hole or grooves.

* * * * *

UNITED STATES PATENT AND TRADEMARK OFFICE

CERTIFICATE OF CORRECTION

PATENT NO. : 7,598,456 B2
APPLICATION NO. : 11/813711
DATED : October 6, 2009
INVENTOR(S) : Adelheid Mertel It is certified that error appears in the above-identified patent and that said Letters Patent is hereby corrected as shown below:

In Col. 6, line 27
replace "sheaths"
with --sheath--

In Col. 8, line 5
replace "grooves"
with --groove--

Signed and Sealed this

Fifteenth Day of December, 2009

David J. Kappos

David J. Kappos
*Director of the United States Patent and Trademark Office*